US005879008A

United States Patent [19]

O'Rourke

[11] Patent Number: 5,879,008

[45] Date of Patent: Mar. 9, 1999

[54] OUTDOOR CARD TABLE

[76] Inventor: M. Kevin O'Rourke, 114 Stemmle Drive, Aurora, Ontario, Canada, L4G 6N8

[21] Appl. No.: 974,053

[22] Filed: Nov. 19, 1997

[51] Int. Cl.[6] ..... A63F 1/10

[52] U.S. Cl. ..... 273/309; 273/148 A; 273/150

[58] Field of Search ..... 273/148 A, 150, 273/309

[56] References Cited

U.S. PATENT DOCUMENTS 1,004,935 10/1911 Taylor ..... 273/148 A
1,957,382 5/1934 Bloodgood ..... 273/148 A
2,717,156 9/1955 Nelson ..... 273/148 A
2,887,789 5/1959 Bobo et al. ..... 273/148 A
3,761,094 9/1973 Belisle ..... 273/148 A

*Primary Examiner*—Benjamin H. Layno

[57] ABSTRACT

An outdoor card playing surface is provided including a table cover having at least one bore formed therein. A plurality of thin rectangular playing cards each have a top face with a common design thereon and a bottom face with playing indicia formed thereon. Each of the playing cards further has a hole formed therein. At least one peg is mounted within the bore of the cover for releasably receiving the hole of any one of the playing cards.

9 Claims, 2 Drawing Sheets

OUTDOOR CARD TABLE

BACKGROUND OF THE INVENTION

1. Field of the Invention

The present invention relates to playing card tables and more particularly pertains to a new outdoor card table for preventing wind and other adverse weather conditions from removing playing cards from a recipient surface.

2. Description of the Prior Art

The use of playing card tables is known in the prior art. More specifically, playing card tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art playing card tables include U.S. Pat. No. 4,844,457; U.S. Patent Des. 281,178; U.S. Pat. No. 4,055,124; U.S. Patent Des. 355,316; U.S. Pat. No. 3,964,403; and U.S. Patent Des. 292,353.

In these respects, the outdoor card table according to the present invention substantially departs from the conventional concepts and designs of the prior art, and in so doing provides an apparatus primarily developed for the purpose of preventing wind and other adverse conditions from removing playing cards from a recipient surface.

SUMMARY OF THE INVENTION

In view of the foregoing disadvantages inherent in the known types of playing card tables now present in the prior art, the present invention provides a new outdoor card table construction wherein the same can be utilized for preventing wind and other adverse conditions from removing playing cards from a recipient surface.

The general purpose of the present invention, which will be described subsequently in greater detail, is to provide a new outdoor card table apparatus and method which has many of the advantages of the playing card tables mentioned heretofore and many novel features that result in a new outdoor card table which is not anticipated, rendered obvious, suggested, or even implied by any of the prior art playing card tables, either alone or in any combination thereof.

To attain this, the present invention generally comprises a rigid table cover having a thin, planar and rectangular configuration with a top face, a bottom face, and a periphery formed therebetween. The cover has a bisecting crease. As shown in FIG. 1, the crease defines a first half and a second half that are adapted to be folded onto each other for storage purposes. The top face of each half of the cover has a matrix of circular bores formed therein over an entire surface area thereof. Associated therewith is a rectangular slot formed in spaced and parallel relationship with the bisecting crease. The rectangular slots of the halves are preferably situated adjacent to each other on direct opposite sides of the crease. FIG. 4 shows one of a plurality of thin rectangular playing cards each having a top face with a common design thereon. A bottom face of each card is equipped with playing indicia. Each of the playing cards further has an elongated oval slot formed along an axis which bisects a pair of short side edges of the playing card. As shown in FIG. 3, a plurality of cylindrical posts are provided each having a pair of hemispherical ends. Each cylindrical post is adapted to be removably coupled within a user selected one of the circular bores of the table cover. The cylindrical posts are each adapted for releasably receiving the oval slots of the cards that are being played. This aids in preventing the inadvertent removal of the card from the table cover. Finally, a pair of rectangular pegs each have a planar rectangular configuration. The rectangular pegs are equipped with a top and bottom long edge having a triangular vertical cross-section. Further, each rectangular peg is adapted to be removably coupled within the pair of rectangular slots. As such, the rectangular pegs serve to releasably receive the oval slot of a plurality of cards thereon to maintain the same uniformly stacked.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outdoor card table apparatus and method which has many of the advantages of the playing card tables mentioned heretofore and many novel features that result in a new outdoor card table which is not anticipated, rendered obvious, suggested, or even implied by any of the prior art playing card tables, either alone or in any combination thereof.

It is another object of the present invention to provide a new outdoor card table which may be easily and efficiently manufactured and marketed.

It is a further object of the present invention to provide a new outdoor card table which is of a durable and reliable construction.

An even further object of the present invention is to provide a new outdoor card table which is susceptible of a low cost of manufacture with regard to both materials and labor, and which accordingly is then susceptible of low prices of sale to the consuming public, thereby making such outdoor card table economically available to the buying public.

Still yet another object of the present invention is to provide a new outdoor card table which provides in the apparatuses and methods of the prior art some of the advantages thereof, while simultaneously overcoming some of the disadvantages normally associated therewith.

Still another object of the present invention is to provide a new outdoor card table for preventing wind and other adverse conditions from removing playing cards from a recipient surface.

Even still another object of the present invention is to provide a new outdoor card table that includes a table cover having at least one bore formed therein. A plurality of thin rectangular playing cards each have a top face with a common design thereon and a bottom face with playing indicia formed thereon. Each of the playing cards further has a hole formed therein. At least one peg is mounted within the bore of the cover for releasably receiving the hole of any one of the playing cards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
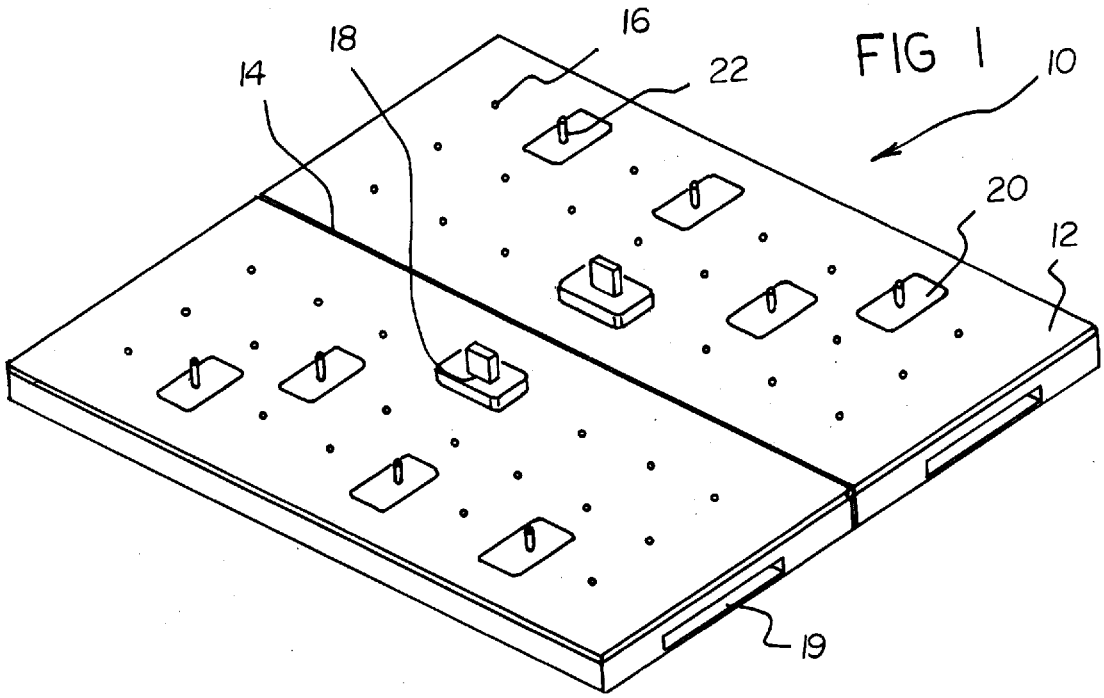
FIG. 1 is a perspective view of a new outdoor card table according to the present invention.
Figure 2:
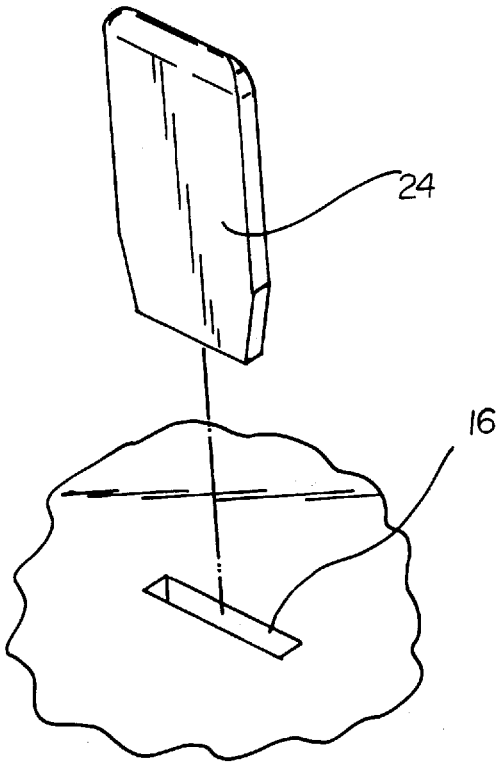
FIG. 2 is a close-up perspective view of one of the rectangular pegs of the present invention.

With reference now to the drawings, and in particular to FIGS. 1 through 4 thereof, a new outdoor card table embodying the principles and concepts of the present invention and generally designated by the reference numeral 10 will be described.

The present invention, as designated as numeral 10, includes a rigid plastic table cover 12 having a thin, planar and rectangular configuration with a top face, a bottom face, and a periphery formed therebetween. The cover has a bisecting crease 14. As shown in FIG. 1, the crease defines a first half and a second half that are adapted to be folded onto each other for storage purposes. As an option, the top face may be lined with felt.

The top face of each half of the cover has a matrix of circular bores 16 formed therein over an entire surface area thereof. Ideally, a matrix of 8×3 is provided. Associated therewith is a rectangular slot 18 formed in spaced and parallel relationship with the bisecting crease. The rectangular slots of the halves are preferably situated adjacent to each other on direct opposite sides of the crease. As an option, a bottom surface of the table cover may define a pair of compartments with drawers 19 for storage purposes. A further option would entail equipping the table cover with legs.

Figure 4:
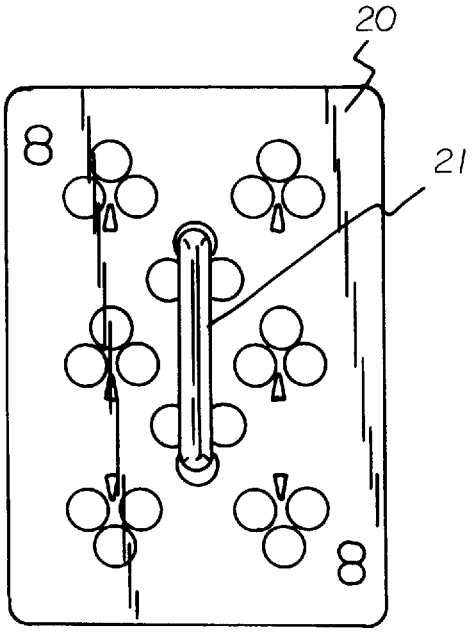
FIG. 4 is a bottom view of one of the cards of the present invention.

FIG. 4 shows one of a plurality of thin rectangular playing cards 20 each having a top face with a common design thereon. A bottom face of each card is equipped with playing indicia. Each of the playing cards further has an elongated oval slot 21 formed along an axis which bisects a pair of short side edges of the playing card. In the preferred embodiment, the slot has a length that is slightly less than that of the card.

Figure 3:
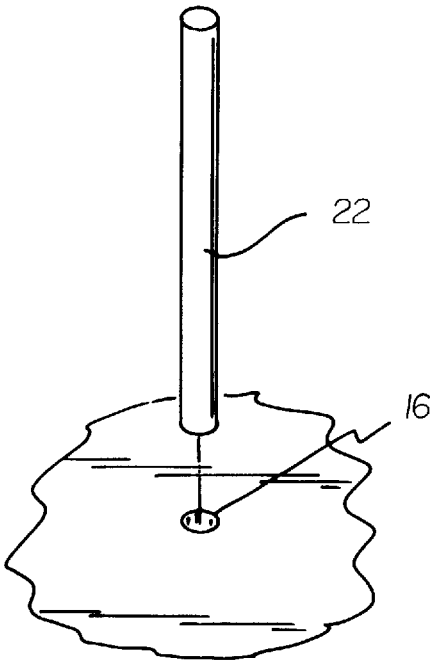
FIG. 3 is a close-up perspective view of one of the cylindrical posts of the present invention.

As shown in FIG. 3, a plurality of cylindrical posts 22 are provided each having at least one hemispherical end. Each cylindrical post is adapted to be removably coupled within one of the circular bores of the table cover. The cylindrical posts are each adapted for releasably receiving the oval slots of the cards that are being played. This aids in preventing the inadvertent removal of the card from the table cover. Each post ideally has a diameter of ⅛ of an inch which is equal to the width of the oval slot of the cards.

Finally, a pair of rectangular pegs 24 each have a planar rectangular configuration. The rectangular pegs are equipped with a top and bottom long edge. At least one of such edges has a triangular vertical cross-section. In the preferred embodiment, both the rectangular pegs and cylindrical posts each have a height of between 2 and 3 inches. During use, each rectangular peg is adapted to be removably coupled within the pair of rectangular slots. As such, the rectangular pegs serve to releasably receive the oval slots of a plurality of cards thereon to maintain the same uniformly stacked. In the preferred embodiment, the rectangular peg and oval slot are dimensioned to prevent any movement of the cards when mated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An outdoor card playing surface comprising, in combination:

a rigid table cover having a thin, planar and rectangular configuration with a top face, a bottom face, and a periphery formed therebetween, the cover having a bisecting crease defining a first half and a second half that are adapted to be folded onto each other for storage purposes, the top face of each half of the cover having a matrix of circular bores formed therein over an entire surface area thereof and further a rectangular slot formed in spaced and parallel relationship with the bisecting crease, wherein the rectangular slots of the halves are situated adjacent to each other on direct opposite sides of the crease;

a plurality of thin rectangular playing cards each having a top face with a common design thereon and a bottom face with playing indicia formed thereon, each of the playing cards further having an elongated oval slot formed along an axis which bisects a pair of short side edges of the playing card;

a plurality of cylindrical posts each having a pair of hemispherical ends, each cylindrical post adapted to be removably coupled within a user selected one of the circular bores of the table cover for releasably receiving oval slots of the cards that are being played to prevent the inadvertent removal of the card from the table cover; and a pair of rectangular pegs each having a planar rectangular configuration with a top and bottom long edge having a triangular vertical cross-section, each rectangular peg adapted to be removably coupled within the pair of rectangular slots for releasably receiving the oval slot of a plurality of cards thereon to maintain the same uniformly stacked.

2. An outdoor card playing system comprising:

a plate having a plurality of bores formed therein;

a plurality of thin rectangular playing cards each having a top face with a common design thereon and a bottom face with playing indicia formed thereon, each of the playing cards further having a hole formed therein; and a plurality of peg mounted within the bores of the plate for releasably receiving the hole of any one of the playing cards;

wherein the pegs are removably coupled to the plate;

wherein the plate is foldable and has a periphery with at least one drawer formed therein for allowing the storage of the pegs therein.

3. An outdoor card playing system as set forth in claim 2 wherein the pegs are each equipped with a cylindrical configuration.

4. An outdoor card playing system as set forth in claim 3 wherein each peg has an end with a hemispherical configuration.

5. An outdoor card playing system as set forth in claim 2 wherein at least one peg has a rectangular configuration and the hole in each card is adapted to fittedly receive the peg.

6. An outdoor card playing system as set forth in claim 5 wherein the rectangular peg has a top edge with a triangular cross-section.

7. An outdoor card playing system as set forth in claim 2 wherein the hole in each card is elongated and the pegs have both a cylindrical and rectangular configuration.

8. An outdoor card playing system comprising:

a plate;

a plurality of thin rectangular playing cards each having a top face with a common design thereon and a bottom face with playing indicia formed thereon, each of the playing cards further having a substantially rectangular hole formed therein; and at least one substantially rectangular peg mounted on the plate for releasably receiving the rectangular hole of any one of the playing cards for maintaining the cards in an aligned stack, wherein the rectangular peg is defined by at least a pair of planar sides.

9. An outdoor card playing system as set forth in claim 8 wherein the rectangular peg has a top edge with a triangular cross-section.

* * * * *